US007681986B2

(12) United States Patent
Shamoun et al.

(10) Patent No.: US 7,681,986 B2
(45) Date of Patent: Mar. 23, 2010

(54) METHODS AND APPARATUS FOR DEPOSITING INK ONTO SUBSTRATES

(75) Inventors: Bassam Shamoun, Fremont, CA (US); John M. White, Hayward, CA (US); Quanyuan Shang, Saratoga, CA (US); Shinichi Kurita, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 270 days.

(21) Appl. No.: 11/761,832

(22) Filed: Jun. 12, 2007

(65) Prior Publication Data

US 2008/0309715 A1 Dec. 18, 2008

(51) Int. Cl.
*B41J 2/25* (2006.01)

(52) U.S. Cl. ..... 347/43; 347/41

(58) Field of Classification Search ..... 347/12–15, 347/40–43

See application file for complete search history.

(56) References Cited

U.S. PATENT DOCUMENTS

| | | | |
|---|---|---|---|
| 5,847,735 | A | 12/1998 | Betschon |
| 6,145,981 | A | 11/2000 | Akahira et al. |
| 6,149,257 | A | 11/2000 | Yanaka et al. |
| 6,154,227 | A | 11/2000 | Lund |
| 6,234,626 | B1 | 5/2001 | Axtell et al. |
| 6,244,702 | B1 | 6/2001 | Sakino et al. |
| 6,264,322 | B1 | 7/2001 | Axtell et al. |
| 6,270,930 | B1 | 8/2001 | Okabe |
| 6,331,384 | B1 | 12/2001 | Satoi |
| 6,386,675 | B2 | 5/2002 | Wilson et al. |
| 6,428,135 | B1 | 8/2002 | Lubinsky et al. |
| 6,428,151 | B1 | 8/2002 | Yi et al. |
| 6,464,329 | B1 | 10/2002 | Koitabashi et al. |
| 6,508,533 | B2 | 1/2003 | Tsujimoto et al. |
| 6,557,984 | B2 | 5/2003 | Tanaka et al. |
| 6,667,795 | B2 | 12/2003 | Shigemura |
| 6,698,866 | B2 | 3/2004 | Ward et al. |
| 6,705,694 | B1 | 3/2004 | Barbour et al. |

(Continued)

FOREIGN PATENT DOCUMENTS

| | | |
|---|---|---|
| JP | 63-235901 | 9/1988 |

(Continued)

OTHER PUBLICATIONS

International Search Report and Written Opinion of International Application No. PCT/US08/07324 (11127-PCT) mailed Aug. 26, 2008.

*Primary Examiner*—Lamson D Nguyen
(74) *Attorney, Agent, or Firm*—Dugan & Dugan, PC

(57) ABSTRACT

Embodiments of an ink jet printing system include a motion stage adapted to move a substrate having a display object in a printing direction and a first printing assembly mounted over the motion stage including a set of print heads aligned and arranged consecutively in the printing direction such that the display object moves under the print heads sequentially. Embodiments of a method of ink jet printing include moving a substrate under the print heads of printing assembly sequentially in a printing direction, activating alternate ink jetting channels within each print head of the first printing assembly, activating corresponding channels within adjacent print heads in the first printing assembly alternately, and depositing ink in alternating sub-pixels within one or more pixels on the substrate.

21 Claims, 8 Drawing Sheets

U.S. PATENT DOCUMENTS

| | | | | |
|---|---|---|---|---|
| 7,249,942 | B2 * | 7/2007 | Silverbrook | 425/375 |
| 2002/0054197 | A1 | 5/2002 | Okada et al. | |
| 2002/0122093 | A1 | 9/2002 | Otsuka | |
| 2003/0189604 | A1 | 10/2003 | Bae et al. | |
| 2003/0218645 | A1 | 11/2003 | Dings et al. | |
| 2004/0008243 | A1 | 1/2004 | Sekiya | |
| 2004/0018305 | A1 | 1/2004 | Pagano et al. | |
| 2004/0023567 | A1 | 2/2004 | Koyama et al. | |
| 2004/0086631 | A1 | 5/2004 | Han et al. | |
| 2004/0125181 | A1 | 7/2004 | Nakamura | |
| 2004/0196329 | A1 | 10/2004 | Ready et al. | |
| 2005/0285896 | A1 | 12/2005 | Hori | |
| 2006/0071957 | A1 | 4/2006 | Shang et al. | |
| 2006/0092199 | A1 | 5/2006 | White et al. | |
| 2006/0092204 | A1 | 5/2006 | White et al. | |
| 2006/0092219 | A1 | 5/2006 | Kurita et al. | |
| 2007/0042113 | A1 | 2/2007 | Ji et al. | |
| 2007/0065571 | A1 | 3/2007 | White et al. | |
| 2007/0068560 | A1 | 3/2007 | Shang et al. | |
| 2007/0070105 | A1 | 3/2007 | Sun et al. | |
| 2007/0222817 | A1 | 9/2007 | Kurita et al. | |
| 2007/0252863 | A1 | 11/2007 | Sun et al. | |
| 2008/0186354 | A1 | 8/2008 | White | |
| 2008/0259101 | A1 | 10/2008 | Kurita et al. | |
| 2008/0291228 | A1 | 11/2008 | White et al. | |

FOREIGN PATENT DOCUMENTS

| | | |
|---|---|---|
| JP | 02-173704 | 7/1990 |
| JP | 10-039130 | 2/1998 |
| JP | 2003-303544 | 10/2003 |

* cited by examiner

METHODS AND APPARATUS FOR DEPOSITING INK ONTO SUBSTRATES

CROSS-REFERENCE TO RELATED APPLICATIONS

The present application is related to the following commonly-assigned, co-pending U.S. patent applications, each of which is hereby incorporated herein by reference in its entirety for all purposes:

U.S. Patent Application Ser. No. 60/795,709 filed Apr. 29, 2006 and entitled "METHODS AND APPARATUS FOR INKJET PRINT HEAD PARKING STRUCTURES";

U.S. patent application Ser. No. 11/019,930 filed Dec. 22, 2004 and entitled "METHODS AND APPARATUS FOR ALIGNING PRINT HEADS";

U.S. patent application Ser. No. 11/123,502 filed May 4, 2005 and entitled "DROPLET VISUALIZATION OF INKJETTING";

U.S. patent application Ser. No. 11/212,043 filed Aug. 25, 2005 and entitled "METHODS AND APPARATUS FOR ALIGNING INKJET PRINT HEAD SUPPORTS";

U.S. patent application Ser. No. 11/238,631 filed Sep. 29, 2005 and entitled "METHODS AND APPARATUS FOR INKJET PRINT HEAD CLEANING";

U.S. patent application Ser. No. 11/466,507 filed Aug. 23, 2006 and entitled "METHOD AND APPARATUS FOR INKJET PRINTING COLOR FILTERS FOR DISPLAYS USING PATTERN DATA";

U.S. patent application Ser. No. 11/521,177 filed Sep. 13, 2006 and entitled "METHOD AND APPARATUS FOR MANUFACTURING A PIXEL MATRIX OF A COLOR FILTER FOR A FLAT PANEL DISPLAY";

U.S. patent application Ser. No. 11/536,540 filed Sep. 28, 2006 and entitled "METHODS AND APPARATUS FOR ADJUSTING PIXEL PROFILES";

BACKGROUND

The flat panel display industry has been attempting to employ inkjet printing to manufacture display devices, in particular, color filters. One problem with effective employment of inkjet printing is that it is difficult to inkjet ink or other material accurately and precisely on a substrate while having high throughput. Additionally, the high resolution and minute scale of pixel and/or inter-pixel dimensions on a color filter may entail technical problems. Such problems may include electrical cross-talking, which may occur between adjacent piezoelectric (PZT) channels on a print head due to the small inter-channel distances used to achieve such high resolution, and chemical cross-talking, i.e., the mixing of inks of different colors, which may be a problem when printing multiple colors of ink on such a minute scale. Accordingly, there is a need for improved systems for arranging print heads and methods for printing that increase throughput while addressing design problems such as electrical and chemical cross-talking.

SUMMARY OF THE INVENTION

In an aspect of the present invention, an ink jet printing system is provided including a motion stage adapted to move a substrate having a display object in a printing direction and a first printing assembly mounted over the motion stage including a set of print heads aligned and arranged consecutively in the printing direction such that the display object moves under the print heads sequentially.

In another aspect of the present invention a method of printing ink on a substrate employing a first printing assembly is provided. The method comprises, during a first print pass, moving the substrate under the print heads of the first printing assembly sequentially in a printing direction, activating alternate ink jetting channels within each print head of the first printing assembly, activating corresponding channels within adjacent print heads in the first printing assembly alternately, and depositing ink in alternating sub-pixels within one or more pixels on the substrate In another aspect of the present invention an ink jet printing apparatus including a printing assembly having a set of print heads aligned and arranged consecutively in the printing direction mountable with respect to a motion stage for conveying a substrate such that a display object positioned on the substrate may move under the print heads of the printing assembly sequentially.

Other features and aspects of the present invention will become more fully apparent from the following detailed description, the appended claims, and the accompanying drawings.

DETAILED DESCRIPTION

The ink jet printing system and associated printing methods provided according to the present invention increase printing throughput, and reduce both electrical cross-talk (e.g., cross-talking between piezoelectric transducer (PZT) channels within ink jet print heads) and chemical cross-talk (e.g., mixing of inks of different colors). The ink jet system provided by the present invention may include one or more printing assemblies each of which may include multiple print heads (e.g., three print heads) mounted on a single support which are operable to deposit ink or other material onto a substrate (e.g., a glass panel, polymer). Each of the print heads in a printing assembly may dispense ink of a different color, for example, red (R), green (G), and blue (B). In one or more embodiments, each print head may be independently rotated, laterally translated, and/or adjusted within one or more of the printing assemblies.

In an example printing method provided according to the present invention, a first set of print heads (e.g., a set including a red ink print head, a green ink print head, and a blue ink print head) in a first printing assembly deposit ink in non-adjacent sub-pixels of a pixel well (e.g., every other sub-pixel) on a substrate in a first print pass. Thereafter, the sub-pixels skipped during the first print pass are filled during a second print pass by alternating the jetting channels of the print heads of the first printing assembly and/or by employing a second set of print heads in a second printing assembly in the same or a subsequent print pass to deposit ink in the sub-pixels of the pixel well skipped by the first set of print heads.

Figure 1:
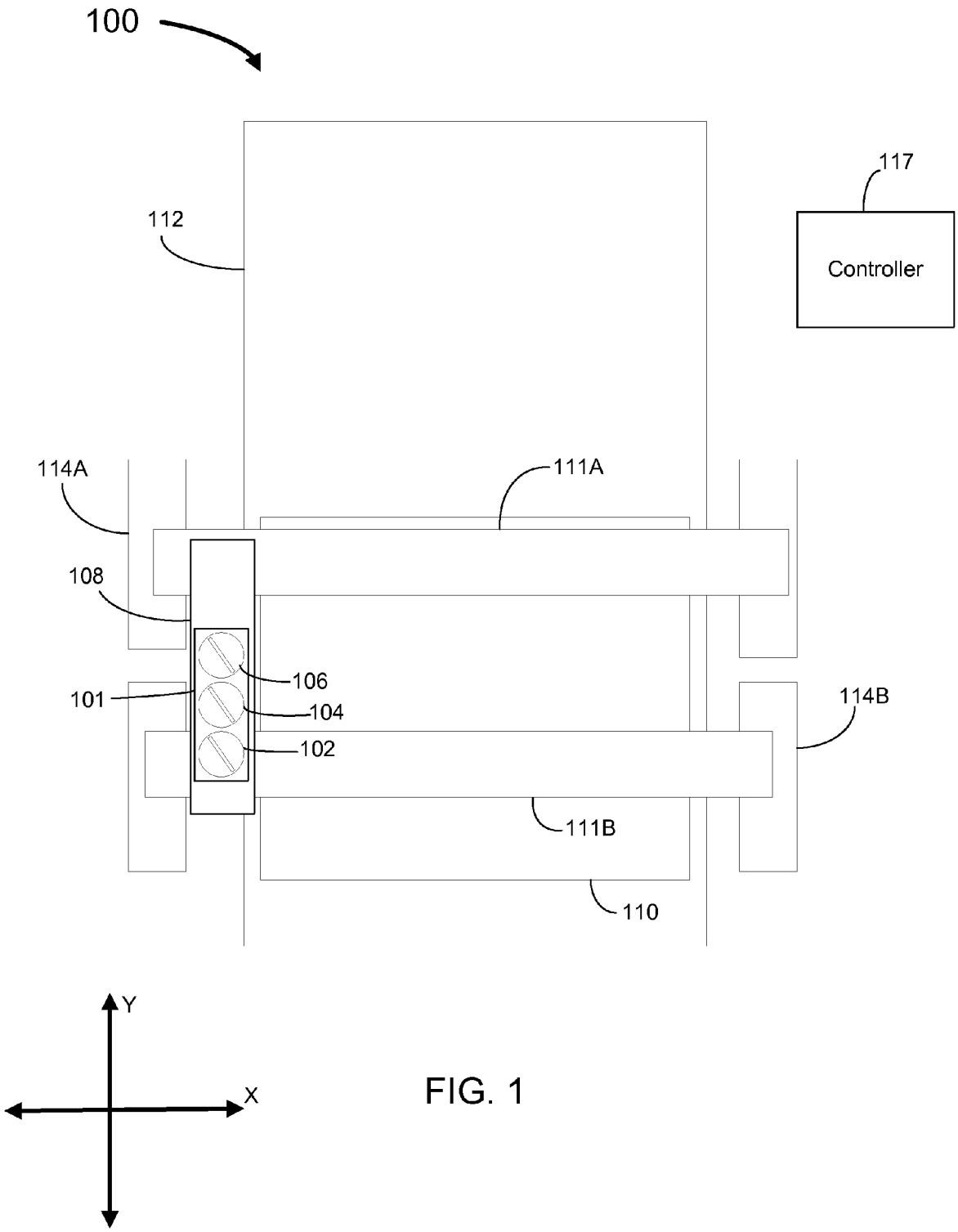
FIG. 1 is a schematic top view of an ink jet printing system including a printing assembly in accordance with embodiments of the present invention.

FIG. 1 is a schematic top view of an example embodiment of a ink jet printing system 100 including a printing assembly 101 provided according to the present invention. The printing assembly 101 includes a set of print heads 102, 104, and 106 disposed on a printing assembly support (e.g., bridge) 108. A motion stage 110, which may be adapted to move in the Y-axis direction (forward or reverse), supports a substrate 112 (e.g., glass panel, polymer) upon which ink may be deposited. Each of the print heads 102, 104, 106 may be supplied with different color ink so that, for example, print head 102 may print red (R) ink, print head 104 may print green ink (G) and print head 106 may print blue (B) ink. Each of the print heads 102, 104, 106 may comprise an SE-128 print head manufactured by Dimatix Inc. of Lebanon, N.H. which includes 128 piezoelectric jetting channels and corresponding jetting nozzles, for example. The nozzles of the SE-128 are arranged in a single line, at approximately 0.020" distance between nozzles. The nozzles are designed to dispense drops from approximately 10 to 12 picoliters but may be adapted to dispense a broader range of drop sizes, for example, approximately 10 to 30 picoliters. Other print heads with differently sized and/or arranged nozzles may also be used. When all of the jetting channels of a print head such as the SE-128 are operated simultaneously, excessive electrical cross-talking can occur between the channels. To ameliorate this problem, typically only a sub-set of the jetting channels of a print head are activated at a given time.

In the embodiment shown in FIG. 1, the support 108 is aligned in the Y-axis direction such that the print heads 102, 104, 106 are arranged consecutively along the Y-axis. In alternative embodiments, the support may be aligned in the X-axis direction. The print heads 102, 104, 106 may be rotatably and/or movably mounted on the printing assembly support 108 such that the print heads 102, 104, 106 can independently move along the printing assembly support 108 in the Y-axis direction and may be free to rotate in the horizontal (X-Y) plane. Each print head 102, 104, 106 may also include a microstage (not shown) allowing for adjustments in the horizontal plane with respect to the printing assembly support 108. For example, such adjustments may allow the print heads 102, 104, 106 within printing assembly to be offset slightly with respect to each other in the X-axis direction on the support 108. Example embodiments of arrangements of coupling print heads to a supporting structure which may be used in the context of the present invention are described in previously incorporated U.S. patent application Ser. No. 11/212,043.

The printing assembly support 108 may in turn be movably coupled to and supported by cross-beam supports 111A and 111B such that the print assembly support 108 may move forwards or backwards in the X-axis direction along the cross-beam supports 111A, 111B. The print assembly support 108 may couple to the cross-beam supports 111A, 111B via ball bearings, air bearings, magnetic bearings, or any other suitable bearings. The cross-beam supports 111A, 111B may be rigidly, movably and/or rotatably coupled to frames 114A, 114B. The frames 114A, 114B may comprise separate structures or may be part of a single supporting structure.

A controller 117 (e.g., a software driven computer, a programmed processor, a gate array, a logic circuit, etc.) may be operatively coupled to the printing assembly 101, the individual print heads 102, 104, 106, the printing assembly support 108, the print stage 110 and cross-beam supports 111A, 111B, to direct operations including translational and rotational movements thereof and in particular, the jetting of ink from the print heads 102, 104, 106 (couplings not shown). In particular, the controller 117 may comprise an electronic driver for controlling the timing and positioning of the jetting of ink from the print heads 102, 104, 106. An example embodiment of an electronic driver that may be used in the context of the present invention is described in previously incorporated U.S. patent application Ser. No. 11/466,507.

Figure 2:
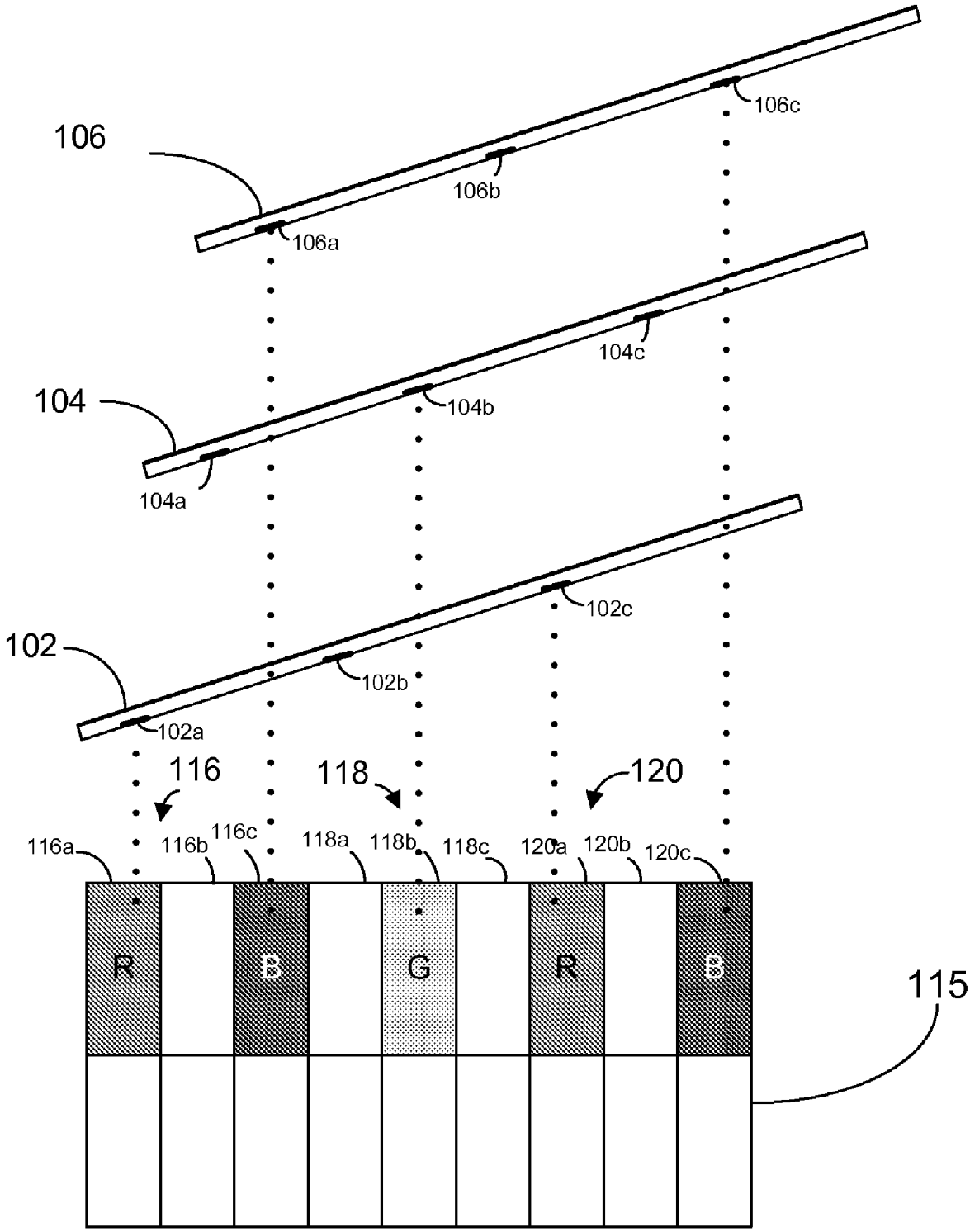
FIG. 2 is a schematic top view of a display object that illustrates an embodiment of a method of printing using a printing assembly according to the present invention.

Referring to FIG. 2, a schematic top view of an example display object 115 is shown. It is noted the depiction of the print heads 102, 104, 106 in which three nozzles are shown (for each print head) is merely a representation, and that each print head 102, 104, 106 may include a far greater number of nozzles (e.g., 128, 256, etc.). The display object 115 may be used as a component of a flat panel display device, such as a color filter of a flat panel monitor or the like. The display object 115 is disposed on the substrate 112 and may comprise a matrix, i.e. rows and columns, of pixels e.g., 116, 118, 120 into which colored ink may be deposited. The substrate 112 may include a black matrix material having wells adapted to receive and store deposited ink. Example embodiments of the black matrix material and pixel wells formed therein that may used in the context of the present invention are described in previously incorporated U.S. patent application Ser. Nos. 11/521,577 and 11/536,540.

Each of the pixels 116, 118, 120 may include respective sub-pixels 116*a*, 116*b*, 116*c*; 118*a*, 118*b*, 118*c*; 120*a*, 120*b*, 120*c* aligned in a row in the X-axis direction. A sub-pixel may represent an area of the pixel that receives the volume of ink from a single jetting of ink from a print head (e.g., one or more ink drops). Each sub-pixel within a pixel, e.g., 116*a*, 116*b*, 116*c* of pixel 116, may be adapted to store a different color, e.g., red, green and blue ink, respectively. In this arrangement, in a given pixel, three consecutive sub-pixels, e.g., 116*a*, 116*b*, 116*c* are filled with the three filter colors (e.g., red, green and blue). Additionally, the corresponding sub-pixels of different pixels, such as 116*a* and 118*a* may store the same color ink, establishing a repeating color pattern across a row of pixels. Thus, each of the columns of a pixel matrix (aligned in the Y-axis direction) may be filled with a single color, while adjacent columns may be filled with different colors. It is noted however that this display coloring scheme is exemplary and that more than one sub-pixel of a given pixel may store a given color of ink, and that the corresponding sub-pixels of different pixels may store different color inks.

During a printing operation, the motion stage 110 may move the display object 115 under print heads 102, 104, and 106 of printing assembly 101. As the print heads 102, 104, 106 are aligned in the printing direction (Y-axis), the display object 115 may be moved under the print heads 102, 104, 106 in sequential order. The print heads 102, 104, 106 may be positioned along the support 108 and calibrated with the display object 115 such that the nozzles of any one of print heads 102, 104, 106 align with a set of corresponding sub-pixels arranged to receive the same color of ink. For example, as shown in FIG. 2, print head 102 is aligned so as to be able to jet ink into sub-pixels 116*a*, 118*a*, 120*a*, print head 104 may be slightly offset with respect to print head 104 and aligned so as to be able to jet ink into sub-pixels 116*b*, 118*b*, 120*b*, and print head 106 may be slightly offset with respect to both print heads 102, 104 and aligned so as to be able to jet ink into sub-pixels 116*c*, 118*c*, 120*c*.

According to one or more embodiments of the present invention, the print heads 102, 104, 106 may be driven such that alternating, non-adjacent channels are activated to jet ink simultaneously, and adjacent channels are not activated simultaneously, reducing electrical cross-talk between adjacent printing channels within a print head. Additionally, print heads 102, 104, 106 may be driven such that if a particular channel of a print head is activated (e.g., channel 1 of print head 102), the corresponding channel of an adjacent print head (e.g., channel 1 of print head 104) is de-activated so that adjacent print heads 102, 104, do not jet ink into the same pixel, which reduces chemical cross-talk between adjacent sub-pixels. Put another way, corresponding channels of adjacent print heads in a printing assembly, e.g., the first channels, are activated alternately during a print pass. Throughput is increased as all of the three print heads 102, 104, 106 in the printing assembly 101 are used at the same time throughout the printing of the display object 115.

During an exemplary printing operation, when the display object 115 comes under print head 102, a first channel (nozzle) 102*a* of print head 102 jets red (R) ink into sub-pixel 116*a*, the second channel 102*b* of the print head 102 does not jet ink as it is adjacent to the first nozzle, effectively skipping (i.e., not jetting ink into) sub-pixel 118*a*, and the third channel 102*c* of print head 102 jets red ink into sub-pixel 120*a*. As the display object 115 moves past the print head 102 and under print head 104, the first channel 104*a* of print head 104 does not jet ink into sub-pixel 116*b*, as adjacent print head 102 has already deposited ink into sub-pixel 116*a* using the corresponding first channel. The second channel 104*b* of print head 104 jets green (G) ink into sub-pixel 118*b*, and the third channel 104*c* of print head 104 does not jet ink as it is adjacent to the second channel. As the display object 115 moves beyond the print head 104 under print head 106, the first channel 106*a* of print head 106 jets blue (B) ink into sub-pixel 116*c*, the second channel 106*b* of print head 106 does not jet ink as it is adjacent to the first channel, and the third channel 106*c* of print head 106 jets blue ink into sub-pixel 120*c*. It is noted that non-adjacent print heads 102, 106 may jet ink into the same pixels 116, 120, but in non-adjacent sub-pixels, 116*a*, 116*c* and 120*a*, 120*c*, respectively.

After the first print pass is completed, a second print pass commences during which the print heads 102, 104, 106 of printing assembly 101 jet ink into the sub-pixels skipped (e.g., 116*b*, 118*a*, 118*c*, 120*b*) during the previous print pass. For example, the stage 110 may move the display object 115 in reverse back under the print heads 102, 104, 106, and the printing channels of the print heads may be activated so as to jet ink into the sub-pixels skipped during the first print pass.

According to this printing method, both electrical cross-talk and chemical cross-talk are reduced; the former, due to the alternating jetting of the print head channels, and the latter due to alternating of jetting in adjacent print heads of the printing assembly such that the print heads do not jet ink into adjacent sub-pixels, minimizing the possibility of ink intended to be deposited in one sub-pixel well (e.g., of a first color) contaminating ink in deposited in an adjacent sub-pixel (e.g., of a second color, different from the first color). It to be understood that the printing method described above is equally applicable in arrangements in which the printing assembly is aligned along the X-axis, in which case the alternation between channels within a print head and between print heads within an assembly may be accompanied by corresponding motions of the print heads along the X-axis on the print support.

Figure 3:
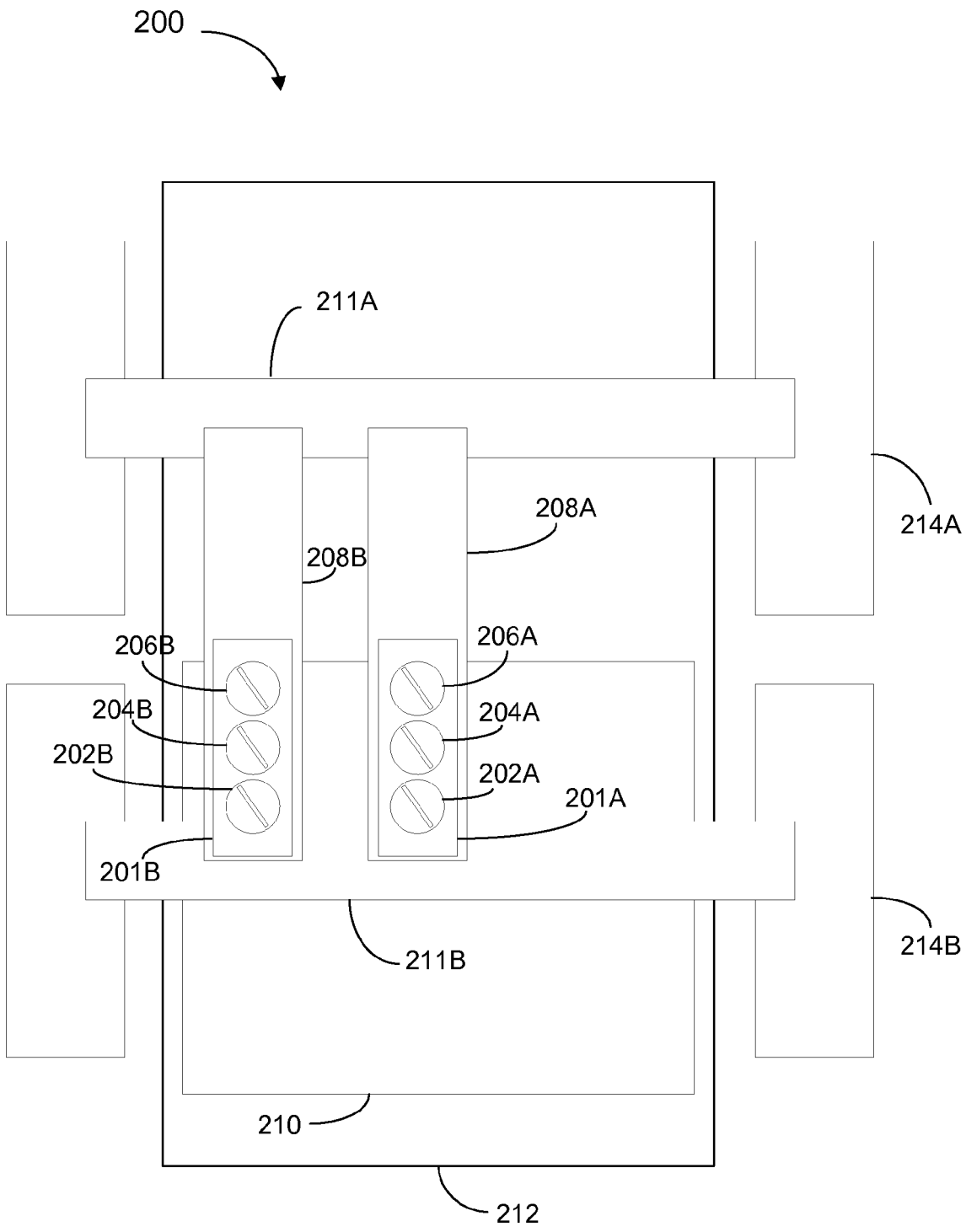
FIG. 3 is a schematic top view of an ink jet printing system including dual printing assemblies in accordance with embodiments of the present invention.

FIG. 3 is a schematic top view of an alternative embodiment of an ink jet printing system 200 according to the present invention. In this embodiment, the printing system 200 includes two printing assemblies 201A, 201B arranged in parallel. Printing assemblies 201A, 201B may be configured similarly to the printing assembly 101 shown in FIG. 1, such that print assemblies 201A, 201B include three print heads 202A, 204A, 206A and 202B, 204B, 206B, respectively. The printing assemblies 201A, 201B may be rotatably and/or movably mounted on separate printing assembly supports 208A, 208B which may be arranged in parallel, aligned in the Y-axis direction and spaced a distance apart along the X-axis. Both printing assembly supports 208A, 208B may be movably coupled to cross-beam supports 211A and 211B such that the supports 208A, 208B may move forwards or backwards along the X-axis, enabling the printing assemblies 201A, 201B to move so as to cover the entire X-axis span of the substrate 212.

In the printing system 200 depicted in FIG. 3, both printing assemblies 201A, 201B may operate simultaneously, providing increased printing throughput. For example, in operation, printing assembly 201A may start printing first in the alternating mode discussed above, skipping a number of sub-pixels during the first pass ('first pass A'). The second printing assembly 201B may, during a first print pass ('first pass B'), print onto the sub-pixels skipped by the first printing assembly during first pass A. This may occur as soon as the space occupied by the first printing assembly 201A during first pass A is physically cleared, allowing the printing assembly 201B to be moved along cross-beam supports 211A, 211B in the X-axis direction over the relevant area of the display object on the substrate 212. In one or more embodiments, the first printing assembly 201A may physically clear from the space occupied during the first print pass A after execution of one or more (e.g., 1, 2, 3) subsequent print passes.

Figure 4:
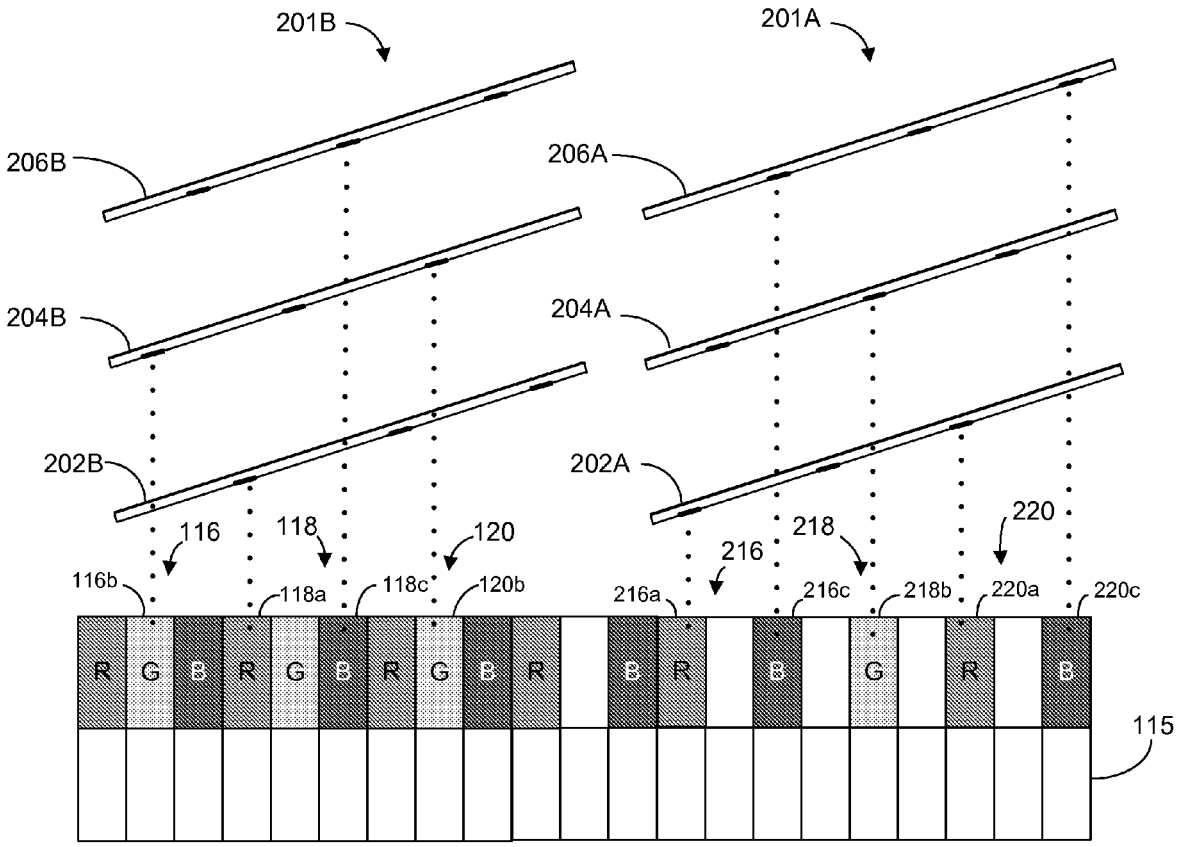
FIG. 4 is a schematic top view of a display object that illustrates of an embodiment of a method of printing using dual printing assemblies according to the present invention.

An exemplary printing operation of the printing system 200 including dual printing assemblies is illustrated in FIG. 4 which is a schematic top view of the example display object 115 shown in FIG. 2. As shown, during a first print pass, printing assembly 201A deposits ink as described above with respect to FIG. 2 in a 'first pixel area' on the display object including pixels 116, 118 and 120. After one or more print passes, the printing assembly support 208A may move in the positive X-axis direction on cross-beam supports 211A, 211B (to the right as viewed in FIG. 4), carrying print head assembly 201A over a 'second pixel area' on the display object including pixels 216, 218 and 220. In FIG. 4, pixels 216, 218, 220 are depicted as directly adjacent to pixels 116, 118, 120. This is merely exemplary however, and the first and second pixel areas may be separated by one or more pixels. Thus, printing assembly 201A may perform a small number of print passes as it moves over the display object between the first and second pixel areas As shown, once the printing assembly 201A is in position over the second pixel area, the print heads 202A, 204A, 206A of print head 201A may then deposit ink into pixels 216, 218, 220 in the same pattern as in pixels 116, 118, 120. In the example embodiment shown, the first channel of print head 202A deposits red (R) ink in sub-pixel 216*a*, the second channel of print head 202A does not jet ink, and the third channel of print head 202A jets red ink into sub-pixel 220*a*. Likewise, the first channel of print head 204A does not jet ink, the second channel of print head 204A jets green (G) ink into sub-pixel 218*b* and the third channel of print head 204A does not jet ink, while the first channel of print head 206A jets blue (B) ink into sub-pixel 216*c*, the second channel of print head 206A does not jet ink into sub-pixel 218*c*, and the third channel of print head 206A jets blue ink into sub-pixel 220*c*.

After the print support 208A carries print assembly 201A entirely past the first pixel area, printing assembly support 208B may move in the positive X-axis direction on cross-beam supports 211A, 211B carrying printing assembly 201B over the first pixel area including pixels 116, 118 and 120. Because the printing assemblies 201A, 201B are aligned along the Y-axis in the example embodiment, they occupy a small footprint in the X-axis direction, with the result that printing assembly 201A may clear the first pixel area relatively quickly, after a small number of subsequent print passes.

When printing assembly 201B is in position over the first pixel area, the print heads 202B, 204B, 206B may deposit ink into the sub-pixels skipped by printing assembly 201A. In particular, the first channel of print head 202B may skip sub-pixel 116*a*, the second channel of print head 202B may jet red (R) ink into sub-pixel 118*a*, and the third channel of print head 202B may skip sub-pixel 120*a*. The first channel of print head 204B may jet green (G) ink into sub-pixel 116*b*, the second channel of print head 204B may skip sub-pixel 118*b* and the third channel of print head 204B may jet green ink into sub-pixel 120*b*. Similarly, print head 206B may skip sub-pixel 116*c*, the second channel of print head 206B may jet blue (B) ink into sub-pixel 118*c*, and the third channel of print head 206B may skip sub-pixel 120*c*. In this manner, precisely the sub-pixels skipped during the first print pass by printing assembly 201A, namely, sub-pixels 116*b*, 118*a*, 118*c* and 120*b*, are filled by printing assembly 201B in a subsequent print pass. Throughput is increased thereby as approximately the same time is used to print the entire display object area as is used to print alternating sub-pixels (i.e., one-half of the display object area) using the single printing assembly shown in FIG. 1 since the dual printing assemblies 201A, 201B may print simultaneously.

It is noted that, similar to the printing operation of print assembly 201A, during the printing operation of printing assembly 201B, no adjacent channels in any of the print heads 202B, 204B, 206B are activated simultaneously, and that no adjacent sub-pixels are filled during a print pass. In this manner, using two printing assemblies 201A, 202B, adjacent sub-pixels are filled by using separate printing assemblies 201A, 201B without incurring any penalty in terms of electrical or chemical cross-talk.

Additionally, while the embodiments above describe skipping a single sub-pixel any number of sub-pixels may be skipped where appropriate. For example, to further reduce electrical cross-talk, every nth (e.g., third, fourth, etc.) print head channel may be activated for jetting, such that n−1 sub-pixels are skipped during a print pass.

Figure 5:
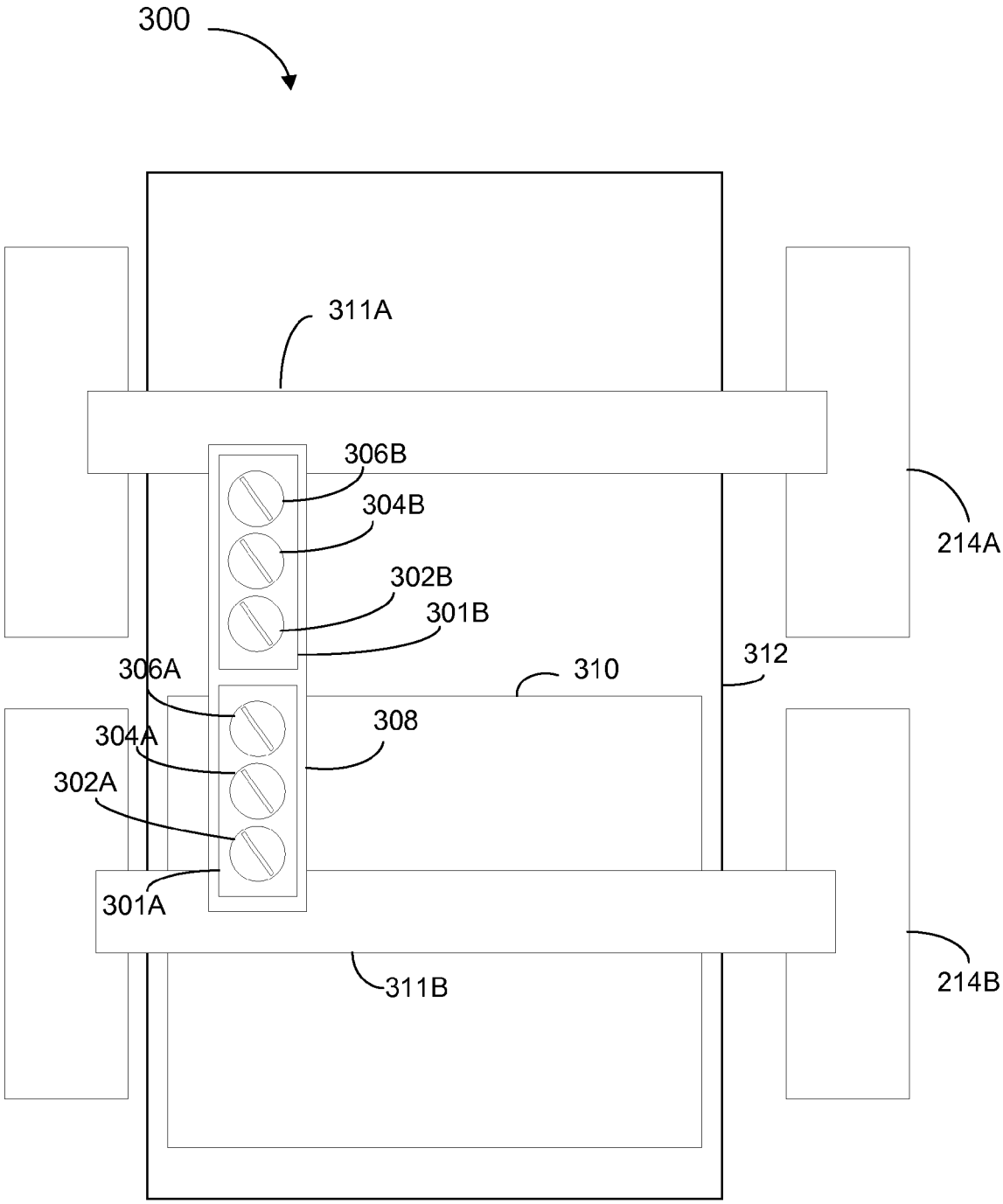
FIG. 5 is a schematic top view of an ink jet printing system including a dual bank printing assembly in accordance with embodiments of the present invention.

FIG. 5 is a schematic top view of another example embodiment of a printing system 300 according to the present invention. In the embodiment of FIG. 5, two printing assemblies 301A, 301B are positioned consecutively in a 'dual-bank' configuration, mounted on a single printing assembly support 308 aligned in the Y-axis direction. In this embodiment, during a printing operation, as the motion stage 310 moves a substrate 312 in the Y-axis direction under the printing assembly 301A, print heads 302A, 304A, 306A may print in alternating sub-pixels in the manner described above. The substrate 312 may then be conveyed further by the stage 310 in the Y-axis direction during the same print pass under printing assembly 301B including print heads 302B, 304B and 306B. The dual-bank configuration shown in FIG. 5 increases throughput relative to systems using a single printing assembly since two printing assemblies 301A, 301B are utilized in each print pass during a single forward motion of the motion stage 310, saving time required to reverse the direction of motion of the motion stage 310.

Furthermore, the printing system 300 provides benefits in terms of design simplicity as all of the print heads 302A, 304A, 306A, 302B, 304B, 306B are mounted on one support 308, which reduces the number of structural components in the printing system 300, and also reduces the number of independent movements and/or operations that are performed during a printing operation. The reduced number of components and/or operations may translate into fewer malfunctions and less maintenance overhead.

Figure 6:
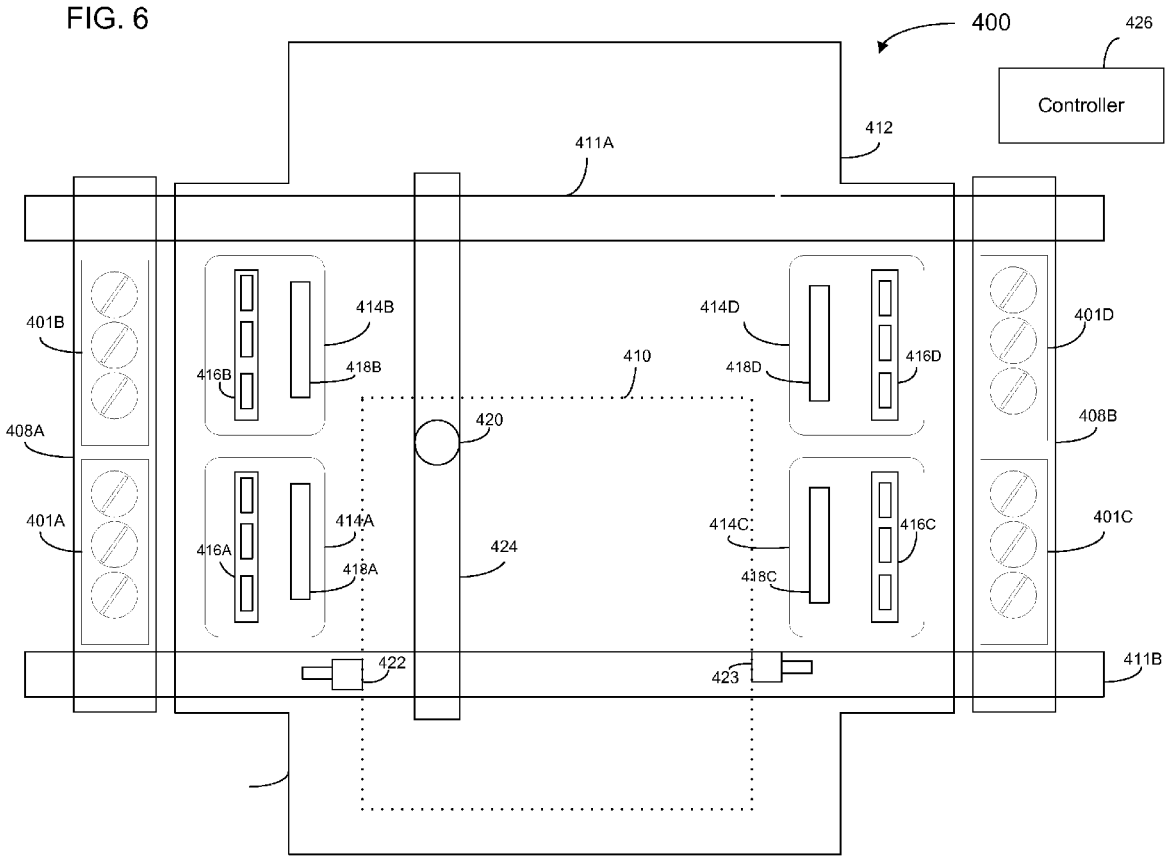
FIG. 6 is a schematic top view of an ink jet printing system including multiple dual banks of printing assemblies in accordance with embodiments of the present invention.

FIG. 6 is a schematic top view of an example embodiment of an ink jet printing system 400 according to the present invention that includes two dual banks of printing assemblies. The embodiment shown in FIG. 6 combines advantages of the configurations shown in FIGS. 3 and 5, as it contains dual printing assemblies (as shown in FIG. 3), each of which is configured as a dual bank assembly (as shown in FIG. 5). In this example printing system 400, a total of twelve (12) print heads may be used during a printing operation. FIG. 6 also depicts maintenance modules and/or features that may be used in the context of any or all of the embodiments of the present invention.

Printing system 400 includes a first dual bank of printing assemblies 401A, 401B mounted and aligned in the Y-axis direction on a first printing assembly support 408A, and a second dual bank of printing assemblies 401C, 401D mounted and aligned in the Y-axis direction on a second printing assembly support 408B. Each of the printing assemblies 401A, 401B, 401C, 401D may include three print heads having structures and functionality similar that that of the print heads employed in the embodiments described above. Printing assembly supports 408A, 408B are movably coupled to cross-beam supports 411A, 411B, such that the supports 408A, 408B may move forwards or backwards along the X-axis. The printing system 400 also includes a motion stage 410 adapted to move a substrate 412 in the Y-axis direction as described above.

Printing system 400 also includes several modules adapted to perform maintenance operations on the print heads of the printing assemblies 401A, 401B, 401C, 401D. In the example embodiment depicted, each printing assembly 401A, 401B, 401C, 401D is allocated a parking and cleaning module 414A, 414B, 414C, 414D which may be fixedly positioned on edges of the motion stage 410 outside the borders of the substrate 412 and/or may be movable in X and Y-axis directions on the motion stage 410. It is noted however, that fewer parking and cleaning modules (e.g., 1, 2, 3) may be used.

Each parking and cleaning module 414A, 414B, 414C, 414D may include a respective set of parking stations 416A, 416B, 416C, 416D and cleaning stations 418A, 418B, 418C, 418D, each adapted to receive a print head. For example, printing and cleaning module 414A may include a set 416A of three parking stations, each parking station in the set 416A configured and adapted to receive a respective one of the three print heads included in printing assembly 401A. In operation, maintenance procedures may occur on a scheduled basis or based on diagnostic determinations that a printing assembly and/or particular print head may require maintenance. For example, it may be determined that a print head within printing assembly 401A has been contaminated with ink and requires cleaning. In this case, printing assembly 401A may move on support 408A over cross beam supports 411A, 411B over parking and cleaning module 414A and/or the parking and cleaning module 414A may move (on its own movement platform, not shown) under the printing assembly 401A. The parking and cleaning module 414A may include features for coupling to and receiving the print head to be cleaned once the printing assembly 401A and parking and cleaning module 414A are properly aligned with respect to each other.

Structures and functions of exemplary parking stations that may be used in parking station sets 416A, 416B, 416C, 416D and exemplary cleaning stations that may be used in cleaning station sets 418A, 418B, 418C, 418D are described in previously incorporated U.S. Patent Application No. 60/795,709 and Ser. No. 11/238,631. The sets of parking stations 416A, 416B, 416C, 416D may be adapted to apply a cleaning solution to print heads received therein via a bath, sprays and/or other application techniques. The sets of cleaning stations 418A, 418B, 418C, 418D may be adapted to clean print heads using a cleaning medium such as a film that may be conveyed over a print head nozzle surface. During a maintenance operation, parking stations and cleaning stations may be used independently, sequentially or otherwise. For example, a print head requiring cleaning may be bathed in solvent in a parking station and then cleaned in a cleaning station sequentially, or the bathing may be skipped and the print head may be cleaned in the cleaning station directly.

Printing system 400 also may include a vision microscope 420 adapted to calibrate positions of print heads within printing assemblies 401A, 401B, 401C and 401D and one or more drop visualization devices (e.g., two devices 422, 423) adapted to determine drop trajectories of ink jetted from the print heads of printing assemblies 401A, 401B, 401C, 401D onto the substrate 412.

Example embodiments of a vision microscope 420 that may be used in the context of the present invention are described in previously incorporated U.S. patent application Ser. No. 11/019,930. The vision microscope 420 may be mounted on support 424 in a manner similar to the mounting of the printing assemblies 401A, 401B and 401C, 401D on respective printing assembly supports 408A, 408B. The vision microscope 420 may be used to determine an amount of skew of display objects (not shown) positioned on the substrate 412. The vision microscope 420 may also be employed to align the substrate 412 on the motion stage 410 using alignment marks on the substrate 412. Alignment of the substrate 412 with respect to the motion stage 410 may provide a fixed frame of reference to facilitate determination of precise locations of pixels and sub-pixels within a display object on the substrate 412, and/or to facilitate calculations of offsets for print head positioning. In one or more embodiments, the vision microscope 420 and/or further dedicated optical detectors may be adapted to view the print heads of printing assemblies 401A, 401B, 401C, 401D to facilitate determination as to whether the print heads may require cleaning and/or other maintenance.

Examples of drop visualization systems 422, 423 which may be used are described in previously incorporated U.S. patent application Ser. No. 11/123,502. The drop trajectories captured by the drop visualization systems 422, 423 may be used to determine ink drop size and jetting speed.

A controller 426 (e.g., a software driven computer, a programmed processor, a gate array, a logic circuit, etc.) may be operatively coupled to the printing assemblies 401A, 401B, 401C, 401D, and the individual print heads included therein, printing assembly supports 408A, 408B, the motion stage 410 and cross-beam supports 411A, 411B, to direct operations including translational and rotational movements thereof and in particular, the jetting of ink from the print heads within printing assemblies 401A, 401B, 401C, 401D.

The controller 426 may also be coupled to various maintenance modules including the parking and cleaning modules 414A, 414B, 414C, 414D, to the vision microscope 420 and support 424, and to the drop visualization devices 422, 423. The controller 426 may be adapted to receive measurement signals generated by the vision microscope 420 and drop visualization devices 422, 423 and to process the measurement signals received. In this regard, for example, the controller 426 may use the measurements received from the vision microscope 420 to make determinations as to the calibration of the print heads of printing assemblies 401A, 401B, 401C, 401D, determine the relative alignment of the substrate 412 with respect to the motion stage 410 and/or offsets for print head positioning. Similarly, the controller 426 may use the measurements received from the drop visualization devices 422, 423 to determine the size of ink drops jetted from a particular print head and the speed at which the ink drops are jetted. The controller 426 may then generate feedback signals to one or more actuators (not shown) adapted to enable adjustments to these parameters if they fall outside of a desired range.

It is noted that the controller 426 may comprise a single processing unit or multiple processing units located together or in separate locations, either proximate to the printing system 400 or in a remote location.

The printing system 400 depicted in FIG. 6 provides a number of advantageous features, including the large increase in throughput enabled by the use of twelve (12) print heads per print pass. In particular, the use of two dual bank assemblies 401A/401B, 401C/401D allows two printing assemblies that are at the same Y-axis position (e.g., printing assemblies 401A, 401C) to print simultaneously, and allows two printing assemblies that are in successive positions with respect to the Y-axis (e.g., printing assemblies 401A, 401B) to print sequentially during a single print pass. Thus, for example, each dual bank of printing assemblies 401A/401B, 401C/401D may deposit ink in a consecutive group of sub-pixels during a print pass, with the first printing assembly in each bank (e.g., 401A, 401C) jetting in alternating sub-pixels, and the second printing assembly in each bank (e.g., 401B, 401D) jetting ink into the sub-pixels skipped by the respective first printing assemblies. Since each dual bank 401A/401B, 401C/401D may operate simultaneously, two such consecutive groups of sub-pixels may be filled in a print pass. This high-throughput is achieved without any penalty in terms of electrical or chemical cross-talk, since the alternating channel activation within a given print head and the alternating print head activation within a given printing assembly described above may also be applied in the printing system 400 of FIG. 6.

Additionally, the printing system 400 demonstrates the scalability of the printing assembly configurations according to the present invention, as the increased number of printing assemblies and associated print heads does not increase the complexity of the system, beyond the optional allocation of additional parking and cleaning modules to accommodate the increased number of print heads. In other words, while twelve (12) print heads are employed in FIG. 6, which is quadruple the number of print heads employed in the embodiment shown in FIG. 1, the same configuration of cross-beam supports and frame structures may be used, and the same visualization systems such as the vision microscope and drop visualization devices (not shown in FIG. 1) may be employed without duplication or increase in scale to support system with a larger number of print heads (e.g., 16, 20, 24, 28, 32, etc.)

Figure 7:
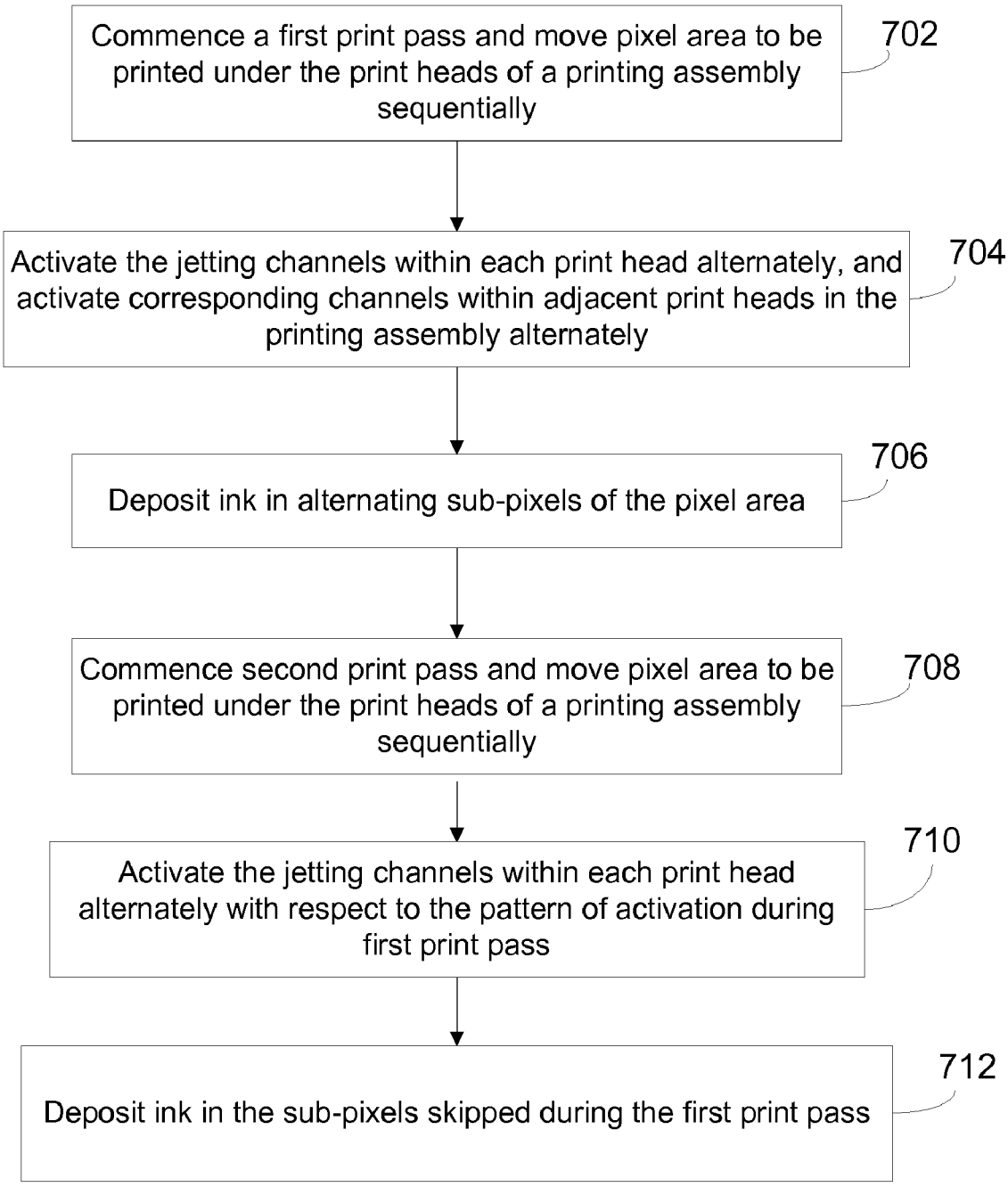
FIG. 7 is a flow chart of an embodiment of a method of ink jet printing in accordance with the present invention that employs the printing system of FIG. 1.

FIG. 7 is a flow chart that illustrates an example embodiment of an ink jet printing method 700 that may be performed using the printing system 100 depicted in FIG. 1. In step 702, a first printing pass commences, in which a pixel area to be printed is moved under the print heads of a printing assembly sequentially. In step 704, the jetting channels within each print head are alternately activated, and within a printing assembly, corresponding channels of adjacent print heads are activated alternately. In step 706, ink is deposited in alternating sub-pixels of the pixel area. In step 708, a second print pass commences, and in step 710, the jetting channels are activated alternately with respect to the pattern of activation employed during the first print pass. In step 712, ink is deposited in the sub-pixels skipped during the first print pass, completely filling the pixel area.

Figure 8:
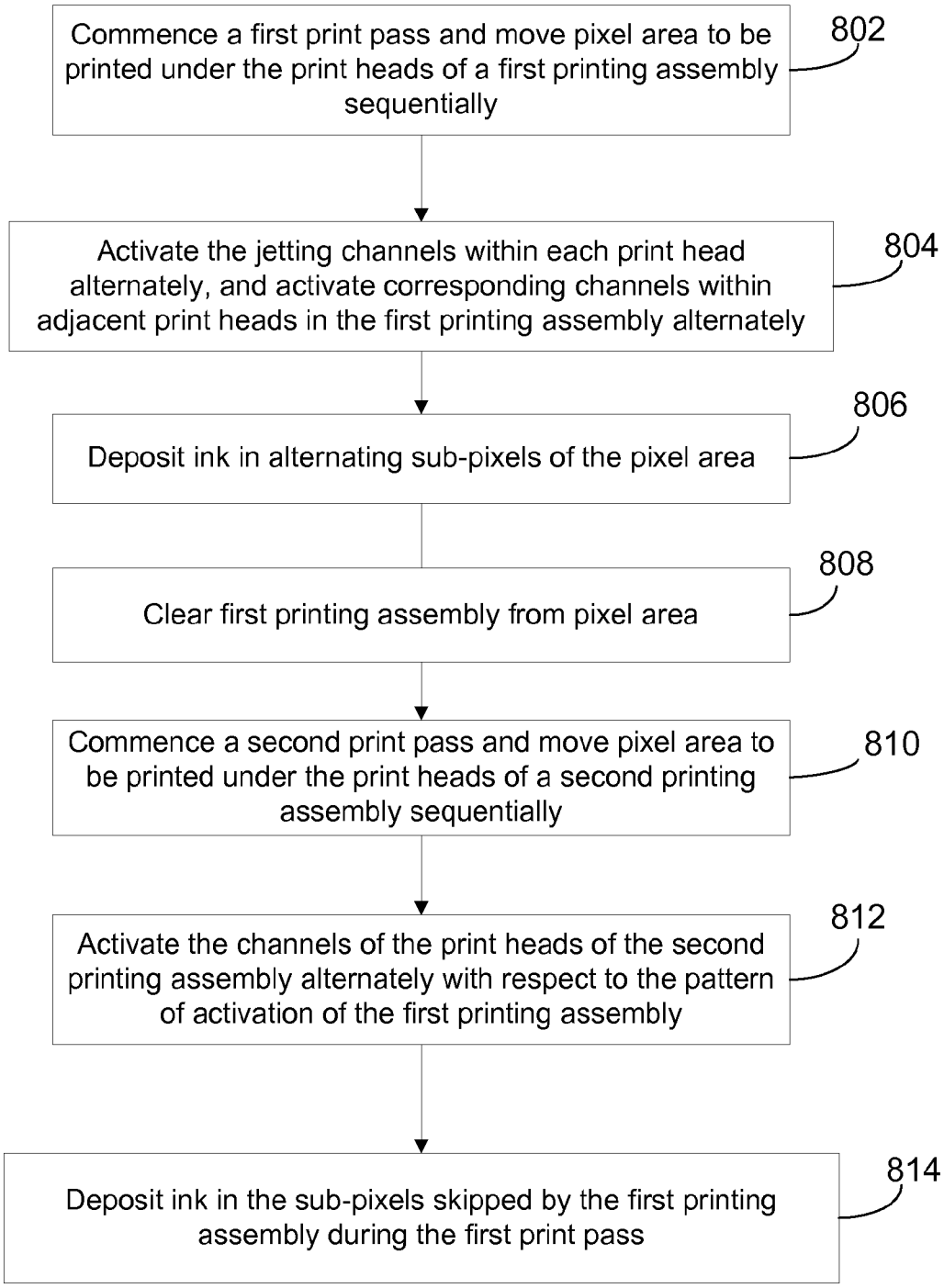
FIG. 8 is a flow chart of an embodiment of a method of ink jet printing in accordance with the present invention that employs the printing system of FIG. 3.

FIG. 8 is a flow chart that illustrates an example embodiment of an ink jet printing method 800 that may be performed using the printing system 200 depicted in FIG. 3. In step 802, a first printing pass commences, in which a pixel area to be printed is moved under the print heads of a first printing assembly sequentially. In step 804, the jetting channels within each print head of the first printing assembly are alternately activated, and within a printing assembly, corresponding channels of adjacent print heads are activated alternately. In step 806, ink is deposited in alternating sub-pixels of the pixel area. In step 808, the first printing assembly is cleared from the pixel area. In step 810, a second print pass commences, in which the pixel area is moved under the print heads of a second printing assembly sequentially. In step 812, the channels of the print heads of the second printing assembly are activated alternately with respect to the pattern of activation of the first printing assembly, i.e., if the first, third and fifth, etc. channels of the first print head within the first printing assembly are activated, then the second, fourth, sixth, etc. channels of the first print head of within the second printing assembly are activated. In step 814, ink is deposited in the sub-pixels skipped by the first assembly during the first print pass, completely filling the pixel area.

It is noted that the embodiments illustrated in FIGS. 7 and 8, are exemplary, and that other activation patterns may be used in addition to strict alternation between adjacent channels (within a single print head and/or between print heads of the printing assembly). For example, any number of sub-pixels may be skipped by deactivating additional channels of the print heads within a printing assembly.

The foregoing description discloses only exemplary embodiments of the invention. Modifications of the above disclosed apparatus and method which fall within the scope of the invention will be readily apparent to those of ordinary skill in the art. For instance, any number of printing assemblies may be used in the above-described systems. Furthermore, a movable maintenance module including a parking and cleaning module, a vision microscope and a drop visualization system may be used. Further, the present invention may also be applied to spacer formation, polarizer coating, and nano-particle circuit forming.

Accordingly, while the present invention has been disclosed in connection with exemplary embodiments thereof, it should be understood that other embodiments may fall within the spirit and scope of the invention, as defined by the following claims.

The invention claimed is:

1. An ink jet printing system comprising:

a motion stage adapted to move a substrate having a display object in a printing direction;

a first printing assembly mounted over the motion stage including a set of print heads aligned and arranged consecutively in the printing direction such that the motion stage may move the display object under the print heads sequentially during a print pass;

a second printing assembly mounted over the motion stage;

a first support positioned over the motion stage, aligned in the printing direction and adapted to move perpendicular to the printing direction; and a second support positioned over the motion stage, aligned in the printing direction parallel to the first support adapted to move perpendicular to the printing direction;

wherein the first printing assembly is mounted on the first support and the second printing assembly is mounted on the second support.

2. The ink jet printing system of claim 1, wherein the set of print heads comprises three (3) print heads.

3. The inkjet printing system of claim 2, wherein each of the print heads is adapted to print a different color ink.

4. The inkjet printing system of claim 3, wherein each of the print heads includes a set of individually activatable jetting channels.

5. The ink jet printing system of claim 4, wherein each of the print heads includes a set of nozzles corresponding to the individually activatable jetting channels arranged in a line.

6. The ink jet printing system of claim 1, further comprising:

a support positioned over the motion stage, aligned in the printing direction and adapted to move perpendicular to the printing direction;

wherein the first printing assembly is mounted on the support.

7. The ink jet printing system of claim 1, wherein the second printing assembly mounted over the motion stage includes a set of print heads aligned and arranged consecutively in the printing direction such that the display object may move under the print heads sequentially during a movement of the motion.

8. The ink jet printing system of claim 7, wherein the second printing assembly is arranged in parallel with respect to the first printing assembly, separated along an axis perpendicular to the printing direction.

9. The ink jet printing system of claim 7, wherein the second printing assembly is aligned with respect to the first printing assembly such that that the display object may move under the first and second printing assemblies sequentially during a print pass.

10. A method of printing ink on a substrate including a matrix of pixels using a first printing assembly having a set of print heads, the method comprising:

in a first print pass:

moving the substrate under the print heads of the first printing assembly sequentially in a printing direction;

activating alternate ink jetting channels within each print head of the first printing assembly;

activating corresponding channels within adjacent print heads in the first printing assembly alternately; and depositing ink in alternating sub-pixels within one or more pixels on the substrate.

11. The method of claim 10, further comprising:

in a second print pass:

moving the substrate under the print heads of the first printing assembly sequentially in a printing direction;

activating the ink jetting channels within each print heads of the first printing assembly alternately with respect to a pattern of activation employed during the first print pass; and depositing ink into sub-pixels within the row of pixels on the substrate skipped during the first print pass.

12. The method of claim 10, wherein the set of print heads includes three (3) print heads.

13. The method of 12, wherein each of the three print heads is adapted to print a different color ink.

14. The method of 10, further comprising:

in a second print pass:

clearing the first printing assembly from an area of the substrate including the one or more pixels filled with ink during the first print pass;

moving the substrate under the print heads of a second printing assembly sequentially in a printing direction;

activating ink jetting channels within each print head of the second printing assembly alternately with respect to a pattern of activation employed during the first print pass; and depositing ink into sub-pixels within the one or more pixels on the substrate skipped by the first printing assembly during the first print pass.

15. The method of claim 14, wherein the second printing assembly is arranged in parallel with respect to first printing assembly, separated along an axis perpendicular to the printing direction.

16. The method of claim 14 wherein the clearing of the first printing assembly comprises moving the first printing assembly in a direction perpendicular to the printing direction.

17. The method of claim 10, wherein the activating of alternate ink jetting channels within each print head of the first printing assembly comprises skipping one channel between activated channels.

18. The method of claim 10, wherein the first printing assembly is aligned in the printing direction.

19. The method of 10, further comprising:

during the first print pass:

moving the substrate under the print heads of a second printing assembly sequentially in the printing direction;

activating ink jetting channels within each print head of the second printing assembly alternately with respect to a pattern of activation employed during the first print pass;

depositing ink into sub-pixels within the one or more pixels on the substrate skipped by the first printing assembly during the first print pass.

20. The method of claim 19, wherein the first and second printing assemblies are aligned and positioned consecutively in the printing direction.

21. The method of claim 19, further comprising:

mounting the first and second printing assemblies on a single support.

* * * * *